US009835990B2

(12) United States Patent
Watanabe

(10) Patent No.: US 9,835,990 B2
(45) Date of Patent: Dec. 5, 2017

(54) IMAGE FORMING APPARATUS, IMAGE FORMING APPARATUS AND NON-TRANSITORY COMPUTER READABLE MEDIUM

(71) Applicant: FUJI XEROX CO., LTD., Tokyo (JP)

(72) Inventor: Kanji Watanabe, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/225,278

(22) Filed: Aug. 1, 2016

(65) Prior Publication Data

US 2017/0205741 A1 Jul. 20, 2017

(30) Foreign Application Priority Data

Jan. 14, 2016 (JP) ..... 2016-005355

(51) Int. Cl.
*G03G 15/00* (2006.01)
*G03G 15/20* (2006.01)

(52) U.S. Cl.
CPC ..... *G03G 15/2039* (2013.01); *G03G 15/5033* (2013.01); *G03G 15/751* (2013.01)

(58) Field of Classification Search
CPC ..... G03G 15/2039; G03G 15/5033; G03G 15/75; G03G 15/751
USPC ..... 399/69, 128, 129, 26, 43
See application file for complete search history.

(56) References Cited

U.S. PATENT DOCUMENTS

2009/0087219 A1 4/2009 Aoshima et al.
2009/0238602 A1* 9/2009 Iwasaki ..... G03G 5/0612 399/111
2012/0155907 A1* 6/2012 Tanaka ..... G03G 15/205 399/69
2015/0153696 A1* 6/2015 Oya ..... G03G 15/556 399/27

FOREIGN PATENT DOCUMENTS

JP 2003-005467 A 1/2003
JP 2009-086328 A 4/2009

* cited by examiner

*Primary Examiner* — Sophia S Chen
(74) *Attorney, Agent, or Firm* — Oliff PLC

(57) ABSTRACT

An image forming apparatus is provided with an image processing unit and a heating controller. The image processing unit includes a charging unit that charges a photoconductor, an electrostatic latent image forming unit that forms an electrostatic latent image by light scanning on the charged photoconductor based on image information, a developing unit that develops the electrostatic latent image, a transfer unit that transfers the developed image to a recording medium, and a fixing unit that fixes the transferred image at least by heating the transferred image. Upon receiving an instruction of execution of recovery processing for recovering sensitivity of the photoconductor that is light-fatigued, the heating controller executes a control so that a temperature of the fixing unit rises at a different time from a time at which the image processing unit performs an image processing operation.

8 Claims, 4 Drawing Sheets

1/4

IMAGE FORMING APPARATUS, IMAGE FORMING APPARATUS AND NON-TRANSITORY COMPUTER READABLE MEDIUM

CROSS-REFERENCE TO RELATED APPLICATIONS

This application is based on and claims priority under 35 USC 119 from Japanese Patent Application No. 2016-005355 filed Jan. 14, 2016.

BACKGROUND

Technical Field

Exemplary embodiments of the invention relate to an image forming apparatus.

SUMMARY

According to an aspect of the invention, an image forming apparatus is provided with an image processing unit and a heating controller. The image processing unit includes a charging unit that charges a photoconductor, an electrostatic latent image forming unit that forms an electrostatic latent image by light scanning on the charged photoconductor based on image information, a developing unit that develops the electrostatic latent image, a transfer unit that transfers the developed image to a recording medium, and a fixing unit that fixes the transferred image at least by heating the transferred image. Upon receiving an instruction of execution of recovery processing for recovering sensitivity of the photoconductor that is light-fatigued, the heating controller executes a control so that a temperature of the fixing unit rises at a different time from a time at which the image processing unit performs an image processing operation

BRIEF DESCRIPTION OF THE DRAWINGS

Exemplary embodiments of the present invention will be described in detail based on the following figures, wherein.

DETAILED DESCRIPTION

<Outline of Image Forming Apparatus 10>

Figure 1:
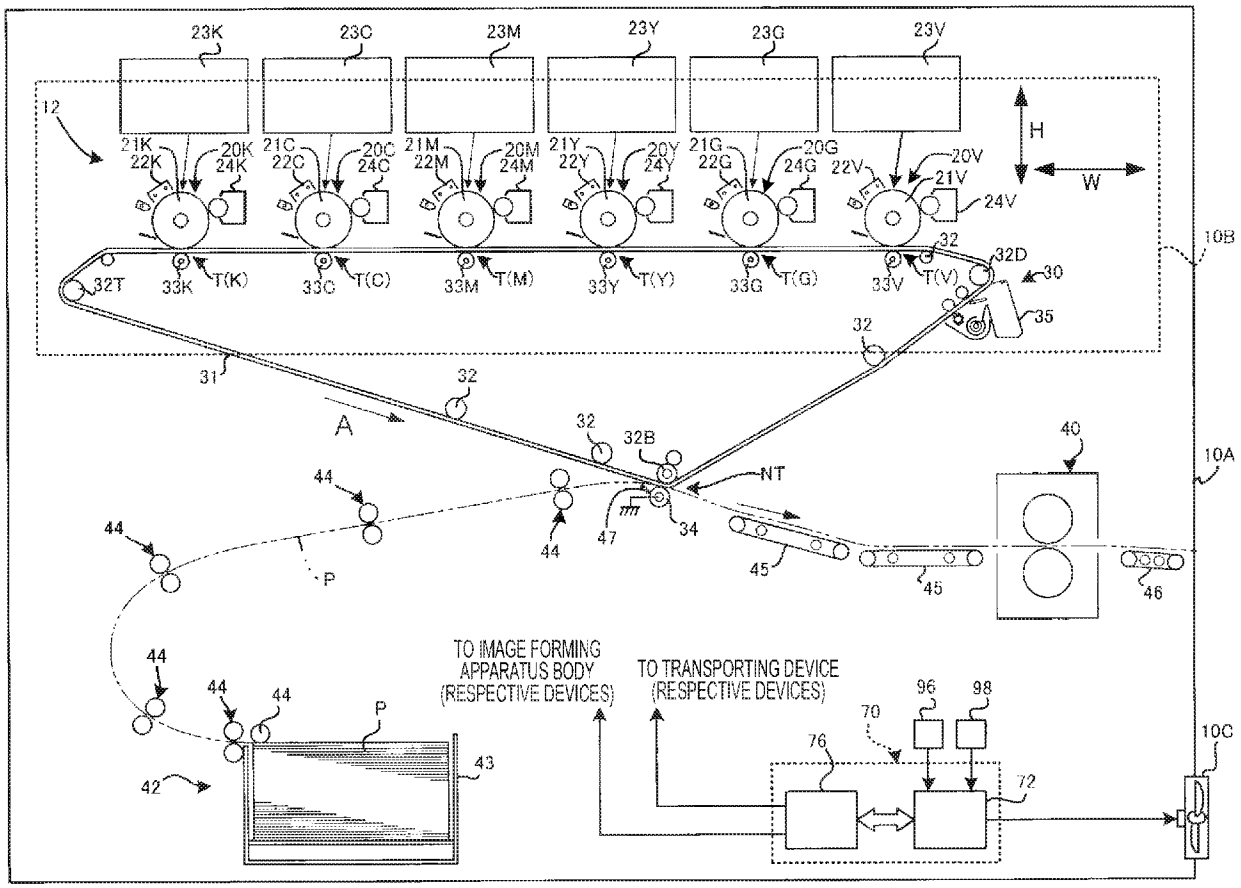
FIG. 1 is a schematic view illustrating a configuration of an image forming apparatus according to an exemplary embodiment which is viewed from a front side.

FIG. 1 illustrates an image forming apparatus 10 according to an exemplary embodiment. Arrow H illustrated in FIG. 1 indicates a vertical direction and arrow W indicates a horizontal direction and an apparatus width direction.

As illustrated in FIG. 1, the image forming apparatus 10 has an image forming apparatus body 12 that is covered by an apparatus housing 10A and forms an image on a recording medium P such as a sheet by an electrophotographic system, a transporting device 42 that transports the recording medium P, and a control device 70 that controls an operation of each unit of the image forming apparatus 10. Moreover, an opening and closing door 10B is provided in a position facing the image forming apparatus body 12 in the apparatus housing 10A.

As illustrated in FIG. 1, the transporting device 42 includes a container 43 in which the recording medium P is contained and has plural transport rolls 44 that are disposed along a transporting path for discharging the recording medium P from the container 43 via a secondary transfer position NT and a fixing device 40 belong to the image forming apparatus body 12, transporting belts 45, and a transporting belt 46.

The image forming apparatus body 12 includes plural toner image forming units 20 for forming a toner image for each color. For example, the toner image forming unit 20 may be required to be replaced mainly caused by fatigue over time, the opening and closing door 10B of the apparatus housing 10A is opened during replacement, and the replacement is able to be performed by pulling out the toner image forming unit 20.

In the exemplary embodiment, the toner image forming units 20 of total six colors of a first spot color (violet "V") and a second spot color (green "G"), normal color yellow "Y", magenta "M", cyan "C", and black "K" are provided in order from an upstream side. In FIG. 1, it is distinguished by adding a symbol of each color at an end of the toner image forming unit 20. Moreover, since the toner image forming unit 20 of each color has the same structure, in the following description, the description may be given by omitting the symbol of each color.

In addition to the toner image forming unit 20, the image forming apparatus body 12 has a transfer device 30 that transfers the toner image formed by the toner image forming unit 20 onto the recording medium P and the fixing device 40 that fixes the toner image, which is transferred onto the recording medium P, to the recording medium P by heating and a pressure.

The toner image forming unit 20 of each color has the basically same configuration except for toner used in the toner image forming unit 20 of each color. Specifically, the toner image forming unit 20 of each color has a photoconductor drum 21 as an example of an image holding element which is rotated in the clockwise direction in FIG. 1 and a charger 22 that charges the photoconductor drum 21. Furthermore, the toner image forming unit 20 of each color has an exposure device 23 that exposures the photoconductor drum 21 charged by the charger 22 and forms an electrostatic latent image on the photoconductor drum 21, and a developing device 24 as an example of a developing unit that develops the electrostatic latent image formed on the photoconductor drum 21 by the exposure device 23 and forms a toner image.

The transfer device 30 primarily transfers the toner image in a primary transfer position T by superposing the toner image of the photoconductor drum 21 of each color on an intermediate transfer belt 31 as an example of an intermediate transfer body and secondarily transfers the superposed toner image to the recording medium P in a secondary transfer position NT. Moreover, the intermediate transfer body may be a drum type (intermediate transfer drum).

Specifically, as illustrated in FIG. 1, the transfer device 30 includes the intermediate transfer belt 31, a primary transfer roll 33 as an example of a primary transfer unit, a secondary transfer roll 34, a cleaning device 47 of the secondary transfer roll 34, a and cleaning device 35 of the intermediate transfer belt 31.

As illustrated in FIG. 1, the intermediate transfer belt 31 is an endless type and a posture thereof is determined by being wound around a plural rolls 32.

In the exemplary embodiment, the intermediate transfer belt 31 has a posture of an inverted obtuse triangle which is long in an apparatus width direction in a front view. a roll 32D illustrated in FIG. 1 among the plural rolls 32 functions as a driving roll for circulating the intermediate transfer belt 31 by power of a motor (not illustrated) in an arrow A direction. The intermediate transfer belt 31 circulates in the arrow A direction and thereby the image which is primarily transferred is transported to the secondary transfer position NT.

In addition, a roll 32T illustrated in FIG. 1 among the plural rolls 32 functions as a tension applying roll for applying a tension to the intermediate transfer belt 31. a roll 32B illustrated in FIG. 1 among the plural rolls 32 functions as a facing roll 32B of the secondary transfer roll 34. A top portion of the intermediate transfer belt 31 on a lower end side forming an obtuse angle of the intermediate transfer belt 31, which is the posture of the inverted obtuse triangle as described above, is wound around the facing roll 32B. The intermediate transfer belt 31 is in contact with the photoconductor drum 21 of each color from below on an upper side extending in the apparatus width direction in the posture described above.

The primary transfer roll 33 is a roll, which transfers an image (hereinafter, may be referred to as "toner image") developed by supplying toner as an example of developer to each photoconductor drum 21 to the intermediate transfer belt 31 and as illustrated in FIG. 1, is disposed on an inward side of the intermediate transfer belt 31. Each primary transfer roll 33 is disposed to face the photoconductor drum 21 of corresponding color in which the intermediate transfer belt 31 is interposed therebetween. In addition, a primary transfer voltage having an opposite polarity to a toner polarity is applied to the primary transfer roll 33 by a power supply unit (not illustrated). The toner image, which is formed on the photoconductor drum 21 by the application of the primary transfer voltage, is transferred to the intermediate transfer belt 31 in the primary transfer position T.

The secondary transfer roll 34 is a roll that transfers the toner image, which is superposed on the intermediate transfer belt 31, to the recording medium P. The secondary transfer roll 34 is disposed so as to cause the intermediate transfer belt 31 to interpose between the facing roll 32B and the secondary transfer roll 34. The secondary transfer roll 34 and the intermediate transfer belt 31 are in contact with each other with a predetermined load.

As described above, the secondary transfer position NT is provided between the secondary transfer roll 34 and the intermediate transfer belt 31 which are in contact with each other as described above. The recording medium P is timely supplied on the secondary transfer position NT from the container 43. The secondary transfer roll 34 is driven to be rotated in the clockwise direction in FIG. 1. Moreover, in the exemplary embodiment, the position between the secondary transfer roll 34 and the intermediate transfer belt 31 also including a case where the secondary transfer roll 34 and the intermediate transfer belt 31 are separated is referred to as the secondary transfer position NT.

The cleaning device 47 is configured with a blade as a removing member that removes foreign matters (toner and powder of the recording medium P) adhered to a surface of the secondary transfer roll 34 from the secondary transfer roll 34 by being in contact with the rotating secondary transfer roll 34.

As illustrated in FIG. 1, the cleaning device 35 is disposed on a downstream side of the secondary transfer position NT and on an upstream side of the primary transfer position T (V) in the circulation direction of the intermediate transfer belt 31.

<Engine Unit Control System>

Figure 2:
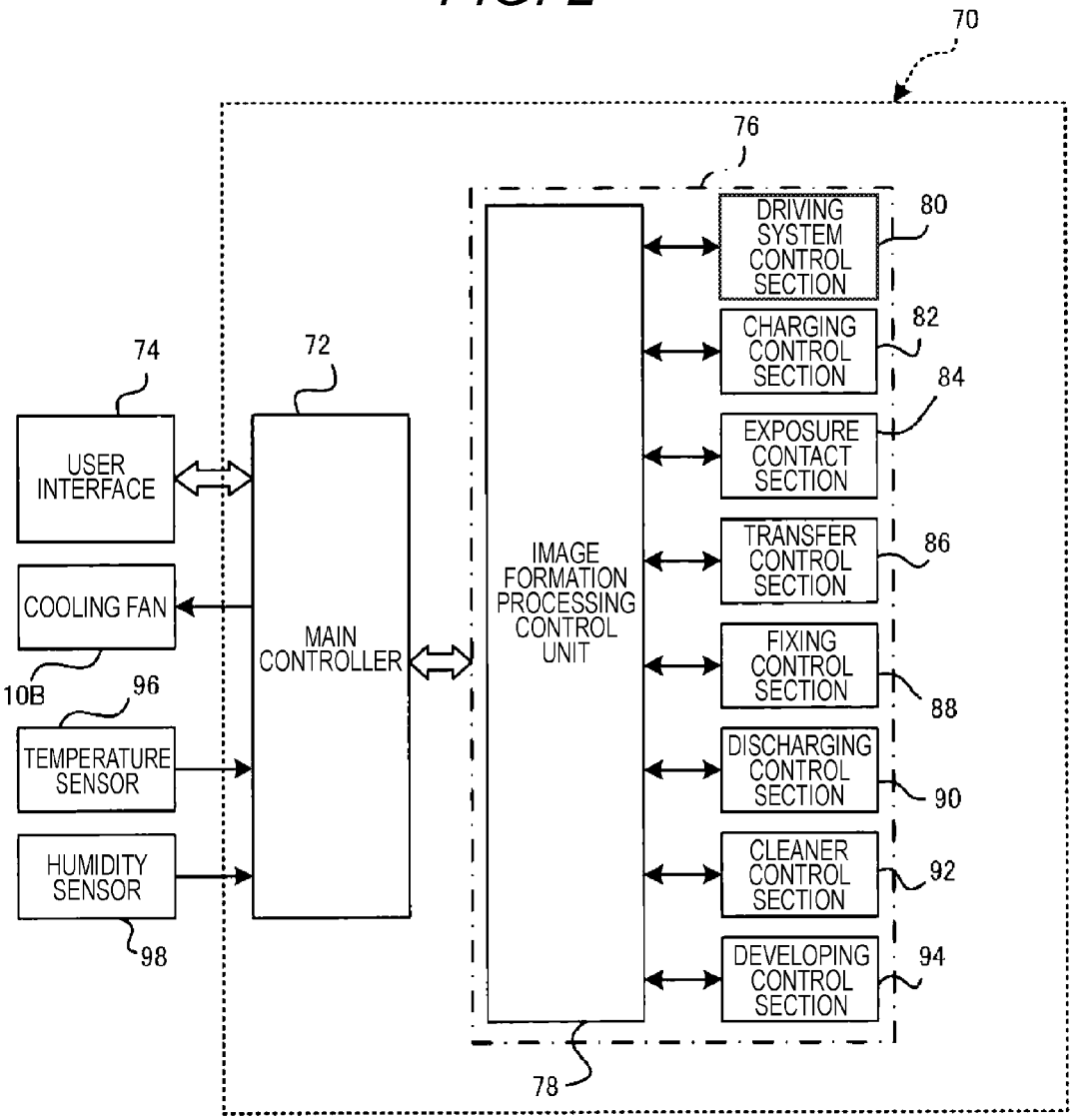
FIG. 2 is a block diagram illustrating a control system of the image forming apparatus according to the exemplary embodiment.

FIG. 2 is a block diagram illustrating an example of the control device 70 of the image forming apparatus 10.

The control device 70 includes a main controller 72 having a main control function of the image forming apparatus 10. A user interface 74 (not illustrated in FIG. 1) is connected to the main controller 72. The user interface 74 includes an input unit for inputting an instruction regarding the image formation and the like, and an output unit for notifying information during the image formation and the like with display or voice.

A network line with an external host computer (not illustrated) is connected to the main controller 72 and image data is input into the main controller 72 via the network line.

If the image data is input, in the main controller 72, for example, print instruction information included in the image data and the image data are analyzed, are converted into a type (for example, bitmap data) suitable for the image forming apparatus 10, and the converted image data is delivered to an the image formation processing control unit 78 functioning as a part of a MCU 76.

The image formation processing control unit 78 synchronously controls a driving system control section 80, a charging control section 82, an exposure control section 84, a transfer control section 86, a fixing control section 88, a discharging control section 90, a cleaner control section 92, and a developing control section 94 which respectively function as the MCU 76, together with the image formation processing control unit 78 based on the input image data, to execute image formation. Moreover, in the exemplary embodiment, the functions performed in the MCU 76 are classified into blocks and are described, and it does not limit a hardware configuration of the MCU 76.

Moreover, a temperature sensor 96 and a humidity sensor 98 are connected to the main controller 72, and environmental temperature and humidity within the housing of the image forming apparatus 10 may be detected based on the temperature sensor 96 and the humidity sensor 98.

In addition, a cooling fan 10C mounted on the apparatus housing 10A is connected to the main controller 72. The cooling fan 10C has a function of exhausting the atmosphere within the apparatus housing 10A by being driven. In other words, if driving of the cooling fan 10C is stopped, a temperature of an inside of the apparatus housing 10A tends to be higher than a normal atmosphere temperature (for example, +20° C.).

<Light Exposure Measures>

In the image forming apparatus 10, if a certain processing amount (processing number of sheets) of sheets is exceeded, it is necessary to replace (hereinafter, including when failure and damage occur, and referred to as "consumption article replacement") components which are deteriorated over time. A representative component is the photoconductor drum 21 of the toner image forming unit 20. The photoconductor drum 21 is unitized with the charger 22, the exposure device 23, and the developing device 24 which are other components. Therefore, the consumption article replacement is performed by a unit of the toner image forming unit 20.

In this case, the opening and closing door 10B of the apparatus housing 10A is opened and the toner image forming unit 20 is pulled out. In this case, the surface of the photoconductor drum 21 is exposed to light (sunlight, fluorescent light, and the like).

For example, trap of charges occurs and the optical fatigue (phenomenon in which light sensitivity becomes dull) occurs in an overcoat layer of the surface of the photoconductor drum 21.

Since the optical fatigue significantly affects the image quality, a replacement operation of the toner image forming unit 20 is required to perform in a situation of not being exposed to light and in a short time. However, in a current installation place, the light exposure may occur due to various factors.

For example, in order to ensure the situation of not being exposed to light, an operation environment, in which the replacement is performed under light of red or yellow wavelength, may be established.

However, the operation environment may not be established depending on the installation place.

In addition, if the replacement is performed while covering the toner image forming unit 20 with a black curtain cover to block the light during the replacement operation of the toner image forming unit 20, the replacement operation that is substantially exposed to the light can be reduced, but the replacement operation may be not efficiently performed.

Furthermore, it is also contemplated that sensitivity reduction corresponding to the light exposure is corrected by light amount adjustment during the image formation, but it is not substantial countermeasures to eliminate the optical fatigue.

Thus, in the exemplary embodiment, it is noted that the optical fatigue is caused by trap of charges described above and the trap of charges is released by heating and in order to recover the optical fatigue, a function of heating the photoconductor drum 21 is added to the image forming apparatus 10.

Moreover, in the exemplary embodiment, a new device for recovering the optical fatigue is not added by using heat of the fixing device 40 that is an existing heating body.

In the exemplary embodiment, the following conditions may be considered as a time at which the optical fatigue recovering process is executed.

(Execution Condition 1) A case where a user orders an execution instruction from the user interface 74.

(Execution Condition 2) A case where, for example, a threshold is provided in a processing amount and periodic maintenance is performed whenever the processing amount exceeds the threshold.

(Execution Condition 3) A case where the execution is performed when the opening and closing door 10B of the apparatus housing 10A is opened including when the consumption article replacement is performed.

If any one of Execution Conditions 1 to 3 is satisfied, in the main controller 72 of the exemplary embodiment, an optical fatigue recovering process sequence which is programmed in advance is started.

In the optical fatigue recovering process sequence, in order to raise an atmosphere temperature within the apparatus housing 10A higher than that of a normal state, the following temperature rising processes are executed.

(Temperature Rising Process 1) Drive stop of the cooling fan 10C.

(Temperature Rising Process 2) Heating temperature change of the fixing device 40.

The photoconductor drum 21 is rotated (idle) in accordance with the temperature rising process in the optical fatigue recovering process sequence. Therefore, the surface of the photoconductor drum 21 is heated within the apparatus housing 10A of which the temperature is higher than that of the normal state.

Moreover, an execution time of the optical fatigue recovering process (heating process) may be increased in proportion to, for example, the instruction value of the user if it is Execution Condition 1, a certain time if it is Execution Condition 2, and the opening time of the opening and closing door 10B if it is Execution Condition 3.

In addition, in a form of a time adjustment, in a normal replacement operation time in a state where apparatus power supply is turned on, an optical fatigue recovering process time may be set to one to two minutes and the replacement operation is determined to be a long period of time in a state where apparatus power supply is turned off, thereby the optical fatigue recovering process time may be set to five to ten minutes.

Hereinafter, operations according to the exemplary embodiment will be described.

<Flow of Normal Imaging Process>

If the control device 70 receives an image formation command (print command), the control device 70 operates the toner image forming units 20Y to 20K, the toner image forming units 20V and 20G of spot colors as required, the transfer device 30, and the fixing device 40 (see FIG. 1).

Therefore, in the toner image forming unit 20, the toner image is formed in the following image forming step (process). That is, the photoconductor drum 21 of each color is charged by the charger 22 while being rotated. Each charged photoconductor drum 21 is exposed by each exposure device 23 and the electrostatic latent image is formed on the surface of each photoconductor drum 21. The electrostatic latent image formed on each photoconductor drum 21 is developed by developer supplied from the developing device 24. Therefore, the toner images of yellow (Y), magenta (M), cyan (C), and black (K) are formed on the photoconductor drum 21 in order from the upstream side. In a case where the spot colors are applied, the toner images of violet (V) and green (G) are formed from further upstream side, and then the toner images of yellow (Y), magenta (M), cyan (C), and black (K) are formed.

The toner image formed on the photoconductor drum 21 of each color is sequentially transferred and superposed in a transfer image region of the circulating intermediate transfer belt 31 by the primary transfer roll 33 of each color.

The toner image of each color, which is overlapped and superposed to the intermediate transfer belt 31, is transported to the secondary transfer position NT by the circulation of the intermediate transfer belt 31.

The recording medium P is supplied to the secondary transfer position NT by the transport roll 44 in synchronization with timing of transporting of the toner image. When the recording medium P and the transfer image region (superposed toner image region) pass through the secondary transfer position NT, a secondary transfer voltage (positive voltage) is applied to the secondary transfer roll 34. Therefore, the toner image is transferred from the intermediate transfer belt 31 to the recording medium P.

The recording medium P to which the toner image is transferred is transported from the secondary transfer position NT to the fixing device 40 by the transporting belt 45. In the fixing device 40, the toner image on the recording medium P is fixed to the recording medium P and is discharged by the transporting belt 46.

<Flow of Optical Fatigue Recovering Process Sequence>

Figure 3:
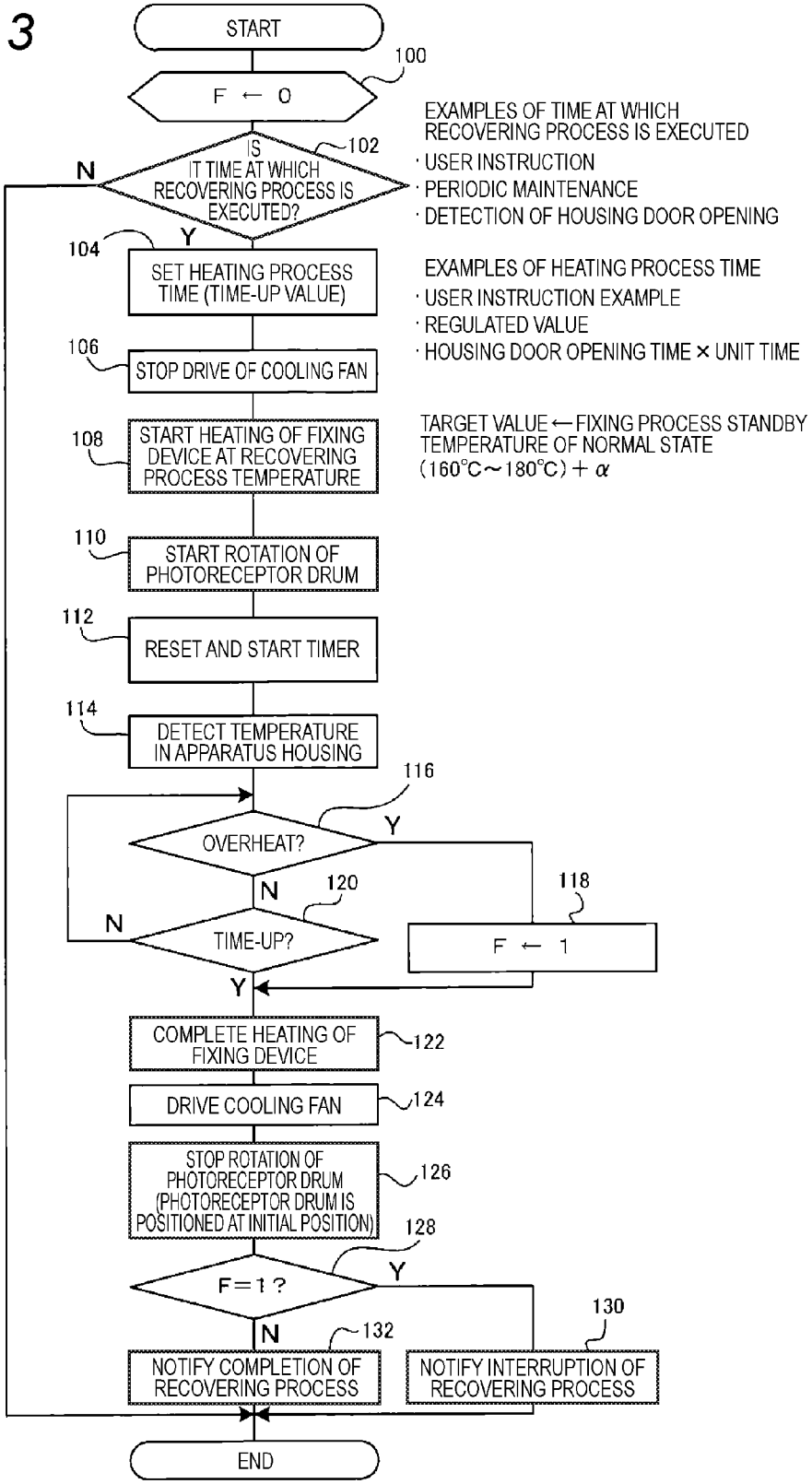
FIG. 3 is a flowchart illustrating an optical fatigue recovering process control routine which is executed by a main controller according to the exemplary embodiment.

FIG. 3 is a flowchart illustrating an optical fatigue recovering process control routine in the main controller 72.

In step 100, a flag F, which is applied when overheating within the apparatus housing 10A is detected, is reset (F←0) and then the procedure proceeds to step 102, and it is determined whether or not it is a time at which an optical fatigue recovering process is executed. The determination whether or not any of Execution Condition 1 to Execution Condition 3 which are described above is satisfied is performed. Moreover, the execution conditions are not limited to Execution Condition 1 to Execution Condition 3 and other conditions, in which a light detecting sensor is provided within the apparatus housing 10A and a condition is satisfied when a light amount is deviated from a light amount (light intensity×time) that is set in advance in the light detecting sensor, may be set.

In a case where a negative determination is made in step 102, it is determined that the optical fatigue does not occur in the photoconductor drum 21 and the routine is completed.

If a positive determination is made in step 102, it is determined that the optical fatigue may occur in the photoconductor drum 21 and the procedure proceeds to step 104.

In step 104, a heating process time is set. The heating process time is set by the execution condition.

That is, in a case where Execution Condition 1 is satisfied, the heating process time is set to a value which is manually indicated by the user. Moreover, a defined value may be stored as a default value.

In a case where Execution Condition 2 is satisfied, the heating process time is set to a defined value (constant time) that is set in advance.

In a case where Execution Condition 3 is satisfied, the heating process time is set to an opening time×unit time of the opening and closing door 10B. The unit time is a heating time with respect to a unit opening time (for example, 10 seconds).

Next, in step 106, drive of the cooling fan 10C is stopped. Drive of the cooling fan 10C is stopped and thereby the atmosphere within the apparatus housing 10A is not discharged and the temperature of the fixing device 40 is raised in a fixing process standby state. Therefore, the temperature thereof is raised higher than that of the normal state.

Next, in step 108, heating of the fixing device 40 is started at a recovering process temperature. The fixing device 40 is controlled to a fixing process standby temperature (for example, 160° C. to 180° C.) in the normal state and the recovering process temperature is to be the fixing process standby temperature of the normal state+α. Therefore, it is possible to quickly raise the atmosphere temperature within the apparatus housing 10A in cooperation with drive stop of the cooling fan 10C.

A guide of a surface temperature of the photoconductor drum 21 may be approximately 40° C. and, as indicated in the following Table 1, a recovery degree of the optical fatigue is different by the optical fatigue recovering process time (heating process time).

Next, in step 110, the rotation of the photoconductor drum 21 is started. The rotation is a so-called idle and it is a state where each process of charging exposure, image recording, developing, and fixing is not executed.

The photoconductor drum 21 is rotated and thereby the photoconductor drum 21 is heated by the atmosphere within the apparatus housing 10A of which the temperature is raised to the recovering process temperature.

The trapped charges generated in the overcoat layer of the photoconductor drum 21 is released by the heating and thereby the optical fatigue is eliminated (recovery of the optical fatigue).

Next, in step 112, a timer is reset and started, and then the procedure proceeds to step 114, the temperature in the apparatus housing 10A is detected by the temperature sensor 96, and the procedure proceeds to step 116.

In step 116, it is determined whether or not the inside of the apparatus housing 10A is in an overheated state (temperature exceeding a limited temperature that is set in advance) based on the detected temperature. In a case where a positive determination is made, the flag F is set (F←1) in step 118 and the procedure proceeds to step 122.

In addition, in a case where a negative determination is made in step 116, the procedure proceeds to step 120 and it is determined whether or not it is time-up, that is, a time of the timer is a time-up value. If a positive determination is made in step 120, the procedure proceeds to step 122.

In addition, in step 120, in a case where a negative determination is made, the procedure returns to step 116 and step 116 and step 120 are repeated until the positive determination is made in step 116 or step 120.

In step 122, heating of the fixing device is completed and then the procedure proceeds to step 124. The cooling fan 10C is driven and the procedure proceeds to step 126.

In step 126, the rotation of the photoconductor drum 21 is stopped, the photoconductor drum 21 is positioned at an initial position, and the procedure proceeds to step 128.

In step 128, it is determined whether or not the flag F is set (F=1).

If a positive determination is made in step 128, the inside of the apparatus housing 10A is in the overheated state and thereby it is determined that the optical fatigue recovering process is interrupted and the procedure proceeds to step 130. The fact that the optical fatigue recovering process is interrupted is notified and the routine is completed.

In addition, if a negative determination is made in step 128, it is determined that the optical fatigue recovering process is completed and the procedure proceeds to step 132. The fact that the optical fatigue recovering process is completed is notified and the routine is completed.

Table 1 is experimental examples indicating the recovery degree of the photoconductor drum 21 which is exposed to the light.

In the experiment, light of 600 Lux is applied to the photoconductor drum 21 for three minutes and the optical fatigue occurs. Thereafter, the photoconductor drum 21 is heated to 40° C. and as a result of sensitivity, G level is displayed. The evaluation G indicates grade evaluation from G0 that is good to G5 that is bad. G5 is a level before the heating process.

As illustrated in Table 1, in a white spot level (52 mm/s), if the photoconductor drum 21 is heated for one minute, the evaluation becomes G2. In addition, the evaluation becomes G0 of the best thereof by heating for five minutes and ten minutes.

On the other hand, as illustrated in Table 1, in a charred black level (165 and 208 mm/s), if the photoconductor drum 21 is heated for one minute, the evaluation becomes G4. In addition, the evaluation becomes G3 of the best thereof by heating for five minutes and ten minutes.

TABLE 1

| Heating Time (Heating on 40° C.) | White Spot Level (52 mm/sec) | Charred Black Level (165 and 208 mm/sec) |
|---|---|---|
| 1 minute | G2 | G4 |
| 5 minutes | G0 | G3 |
| 10 minutes | G0 | G3 |

Evaluation ranges 6 grades of from G0 (no unevenness) to G5 (unevenness). G0 to G3 are determined to be good.

According to the exemplary embodiment, the recovering process of the optical fatigue can be performed without adding a heating unit. For example, the recovery of the optical fatigue, that is, release of trapped charges is reliably performed rather than the optical fatigue is inconspicuous on the image quality.

In addition, since the fixing device 40 is used as the heating unit, it is possible to reduce the heating time of the fixing device 40 when the image forming process is performed after the recovering process of the optical fatigue. In addition, an operation opportunity of an image quality correction sequence due to a temperature difference is reduced and productivity is increased more than that in an imaging process which is performed by warming up from a completely stop state of the apparatus by the heating process by the optical fatigue recovering process.

Modification Example

Figure 4A:
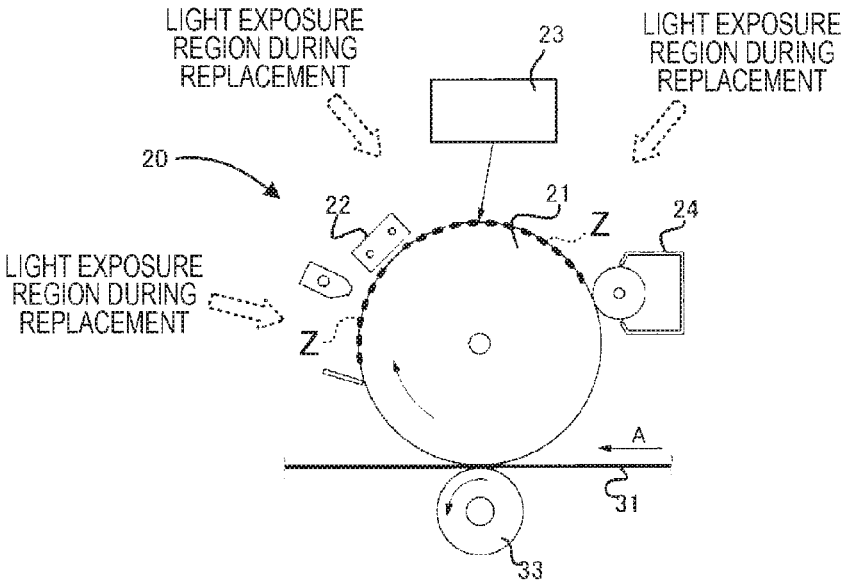
FIGS. 4A and 4B are enlarged views of a toner image forming unit according to the exemplary embodiment, FIG. 4A illustrating a position of a state where a photoconductor drum is exposed to light, and FIG. 4B illustrating a position of a state where the photoconductor drum executes the optical fatigue recovering process.

In the exemplary embodiment described above, the photoconductor drum 21 is driven to be rotated during the optical fatigue recovering process, but, for example, as illustrated in FIG. 4A, during the consumption article replacement, the photoconductor drum 21 is exposed to the light and the exposure is often concentrated on an upper surface (see dotted line Z of FIG. 4A) of the photoconductor drum 21 (optical fatigue concentration region).

Figure 4B:
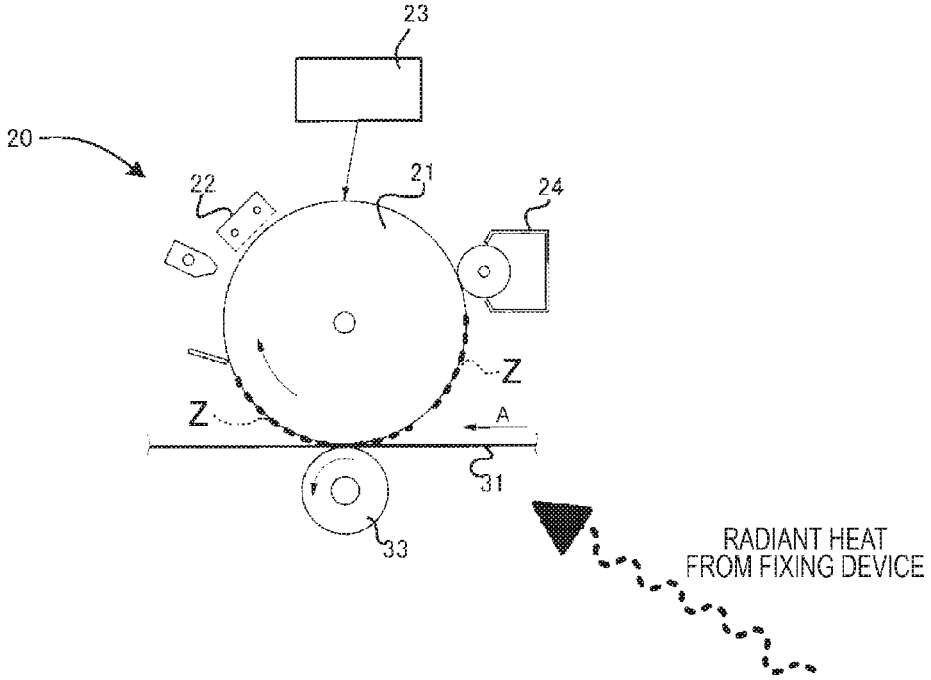

Then, as a modification example, when executing the optical fatigue recovering process, as illustrated in FIG. 4B, a rotational position of the photoconductor drum 21 is determined and the optical fatigue recovering process may be executed in a state of being fixed so that the optical fatigue concentration region of the photoconductor drum 21 faces the fixing device 40.

As illustrated in FIG. 4B, in a case where the rotational position of the photoconductor drum 21 is the fixed position, since radiant heat from the fixing device 40 directly acts on the optical fatigue concentration region, it is possible to recover the optical fatigue faster than the optical fatigue recovering process with convection heat by the atmosphere within the apparatus housing 10A.

Moreover, as illustrated in FIG. 1, since the directions of the toner image forming units 20 are different from each other when viewed from the fixing device 40, it is preferable that orientation of each toner image forming unit 20 faces an effective range of radiant heat of the fixing device 40.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image processing unit including:

a charging unit that charges a photoconductor;

an electrostatic latent image forming unit that forms an electrostatic latent image by light scanning on the charged photoconductor based on image information;

a developing unit that develops the electrostatic latent image;

a transfer unit that transfers the developed image to a medium, and a fixing unit that fixes the transferred image at least by heating the transferred image; and a heating controller configured to execute a control so that a temperature of the fixing unit rises at a different time from a time at which the image processing unit performs an image processing operation, upon receiving an instruction of execution of recovery processing of recovering sensitivity of the photoconductor that is light-fatigued.

2. The image forming apparatus according to claim 1, wherein the photoconductor is rotated during the execution of the recovering process by the heating controller.

3. The image forming apparatus according to claim 1, wherein the photoconductor is rotated and a particular surface is stopped to face a direction in which the fixing unit is disposed, during the execution of the recovering process by the heating controller.

4. The image forming apparatus according to claim 1, wherein the temperature of the fixing unit risen by the control of the heating controller is higher than a temperature of the fixing unit during standby of an image formation processing operation.

5. The image forming apparatus according to claim 1, further comprising:

a ventilation unit that ventilates an atmosphere within a housing that houses the image processing unit, wherein the ventilation by the ventilation unit is paused during the execution of the recovering process by the heating controller.

6. The image forming apparatus according to claim 1, further comprising:

an estimation unit that estimates whether optical fatigue occurs in the photoconductor, wherein in a case where the estimation unit estimates that optical fatigue occurs in the photoconductor, the execution of the recovering process is instructed.

7. The image forming apparatus according to claim 6, wherein the estimation unit detects opening and closing of a door caused by replacement of the photoconductor.

8. The image forming apparatus according to claim 7, wherein the time at which the optical fatigue recovering process is executed is set based on an opening time of the door.

* * * * *